United States Patent [19]

Terpay

[11] 4,138,514

[45] Feb. 6, 1979

[54] PILE SURFACE RESEMBLING TURF AND METHOD OF MAKING IT

[76] Inventor: John M. Terpay, 528 River Oak Dr., Danville, Va. 24541

[21] Appl. No.: 909,439

[22] Filed: May 25, 1978

[51] Int. Cl.[2] ..... A41G 1/00

[52] U.S. Cl. ..... 428/17; 156/91; 156/92; 156/189; 156/190; 156/191; 156/429; 428/37; 428/85; 428/92; 428/99; 428/225

[58] Field of Search ..... 428/17, 37, 85, 92, 428/99, 225; 156/91, 92, 189, 190, 191, 429

[56] References Cited

U.S. PATENT DOCUMENTS

| | | | |
|---|---|---|---|
| 3,673,056 | 6/1972 | Nadler | 428/17 |
| 3,928,694 | 12/1975 | Reinhard | 428/92 |

*Primary Examiner*—Marion E. McCamish
*Attorney, Agent, or Firm*—Fisher, Christen and Sabol

[57] ABSTRACT

A turf-like product suitable for use as a golf tee surface is constructed of artificial turf units which are strung on a plurality of tie rods which are secured at both ends. Each turf unit comprises a number of superimposed layers of a polymeric tape having slits which are transverse to the length of the tape. Holes are programmed in determined frequency along the length of each layer by a heated plunger which passes through the layers of tape. The layers of tape are fused together at the circumference of each hole whereby integrity in the turf unit is obtained. The programmed holes are also used as a mechanical device to construct the pile surface by means of the tie rods. The superimposed layers may be formed by winding the tape on a skein winder.

10 Claims, 6 Drawing Figures

FIG. 1
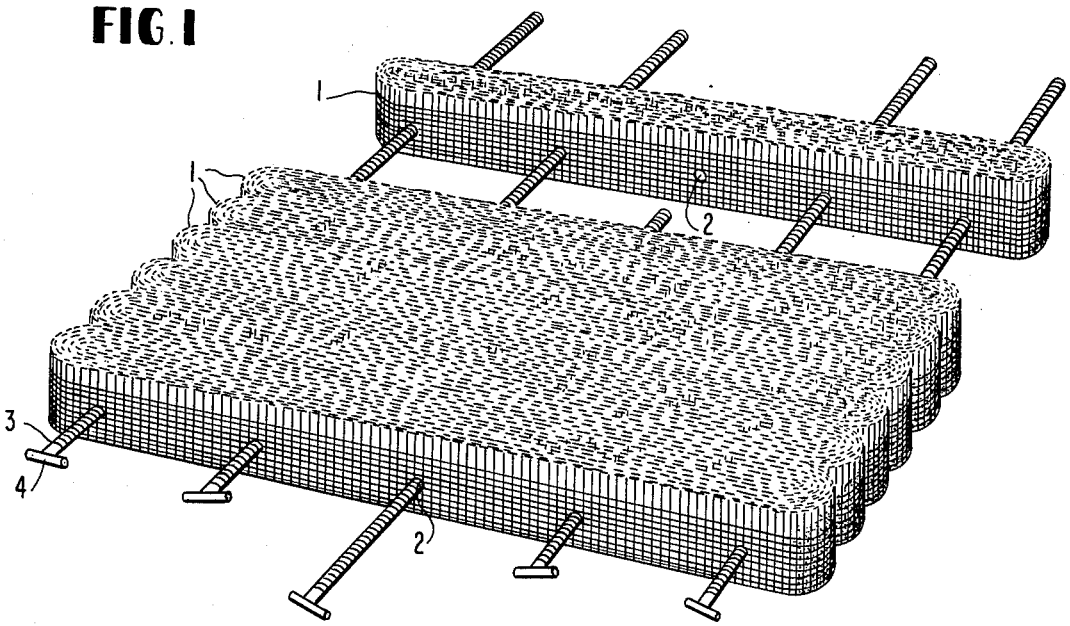
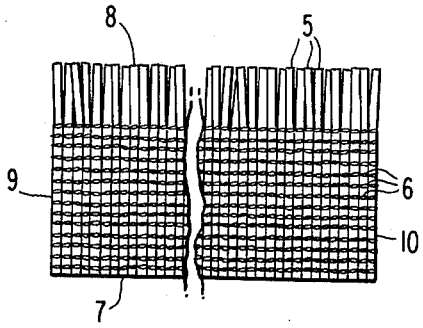
FIG. 2
FIG. 3
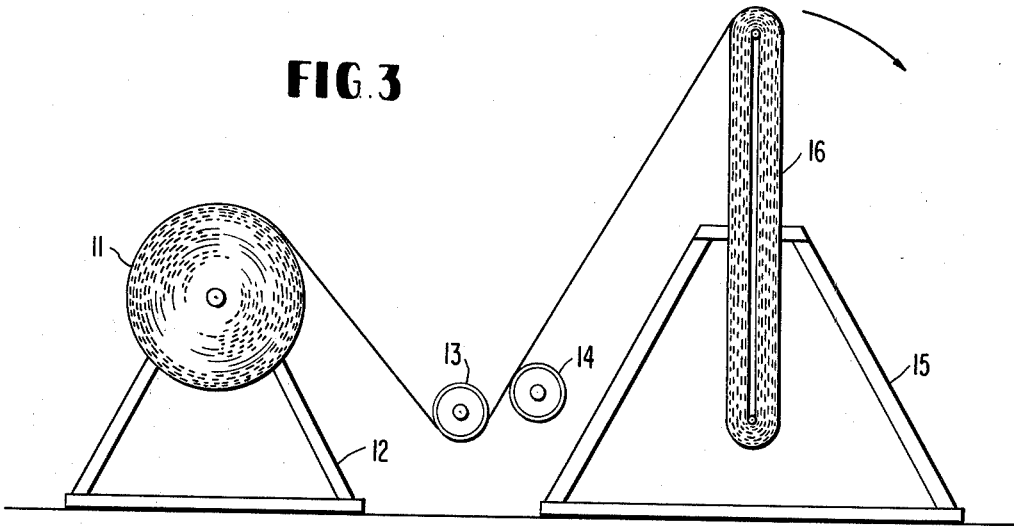

FIG. 4
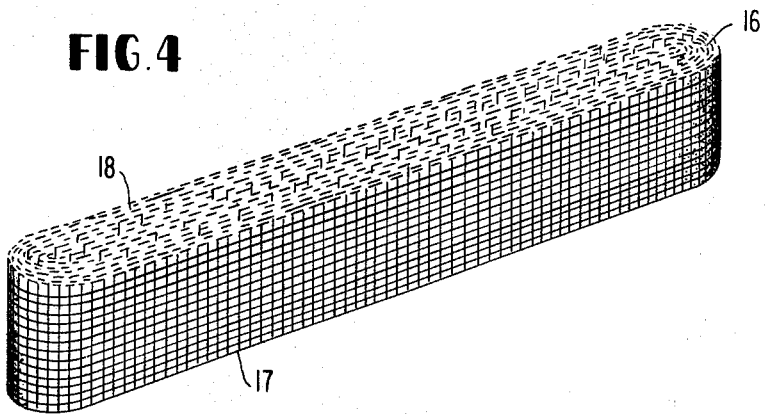
FIG. 5
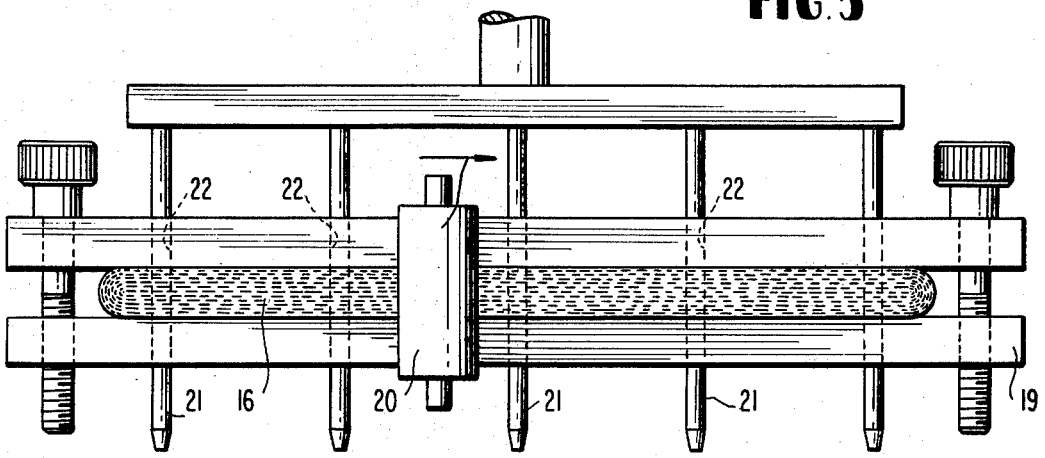
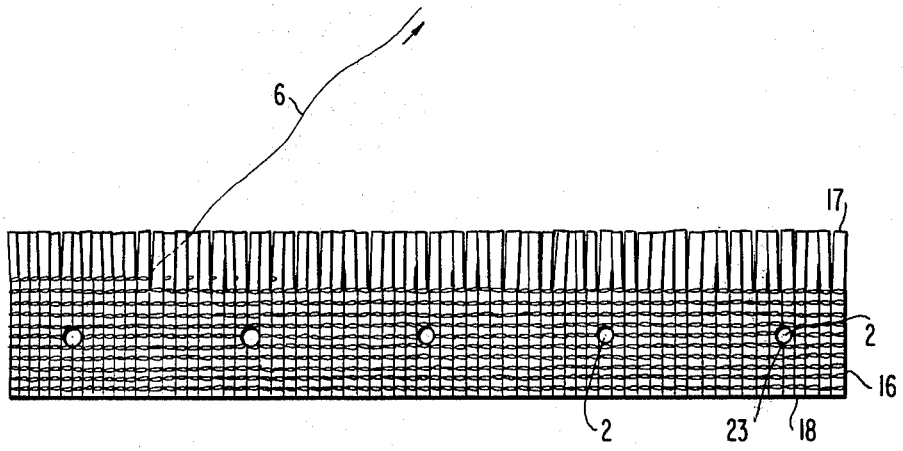
FIG. 6

PILE SURFACE RESEMBLING TURF AND METHOD OF MAKING IT

BACKGROUND OF THE INVENTION

This invention relates to a product having a turf-like appearance. It also concerns a process for manufacturing such a product.

Man-made products having a turf-like appearance and which can withstand the abuse and punishment to which a playing field is subjected are in growing demand. A natural turf playing field for football, baseball, golf, soccer, and other outdoor games is difficult and costly to keep in functional and attractive condition. Bad weather, insects, frequent and severe use, in particular, contribute to rapid deterioration of natural turf playing fields. One of the most severely abused playing surfaces is a golf tee surface. In addition, the condition of the golf tee surface is intimately related to both the attainment of a suitable drive shot and to minimizing the injury to a player whose golf club impacts the tee surface in an undesirable manner.

SUMMARY OF THE INVENTION

The present invention provides a product having a turf-like appearance which is particularly suitable for use as a golf tee surface. The final turf surface is made from a plurality of turf units which are joined by a plurality of tie rods. Each unit is made from a tape having a plurality of slits extending at least partially across the width of the tape. The slits are spaced so that the portion of the tape between two consecutive slits resembles a blade of grass. The tape is arranged in superimposed layers to form a tape bundle. The layers of superimposed tape within the bundle are optionally fused together along one elongated edge. To form the turf unit, a plurality of holes are created in the tape bundle along the length of each layer by a series of heating element rods so that: a) the holes in each layer are in substantial registry with the holes in the other layers to form a plurality of series of holes and b) the layers are fused to each other at peripheral, marginal areas around each hole. Fusion of the tape layers at the holes and at the elongate edges provides integrity to the turf unit. The turf units are strung onto tie rods which pass through the holes in the tape.

The present invention also provides a novel process for preparing a product having a turf-like appearance. The turf units of the present invention are advantageously formed by winding a roll of tape onto a skein winder until the skein reaches a desired thickness. The skein is removed, placed in a vise, and compressed so as to bring the layers of tape forming the skein into close contact. A series of heating element rods are inserted into holes which are programmed in the vise holding the skein. The heated rods melt their way through the skein creating holes in the skein and fuse the layers of tape around the peripheral, marginal areas of the holes. To provide additional reinforcement to the turf unit, a hot roll may be passed over the tips of the tape (facing up) while the skein is compressed in the vise. The skein is removed from the vise and strung on the rods to form a surface area of desired dimension. Optionally, after removal from the vise, the skein can be cut to a desired length. Preferably, the cut end is fused by means of a hot-cutting device. Alternatively, fusing can occur in a separate step by means of a vise and hot roller arrangement as discussed above.

Preparation of the turf unit by means of the skein winder is considerably more economical, takes less time, and results in a more even turf surface than cutting the tape into strips and then superimposing the strips on one another.

OBJECTS OF THE INVENTION

It is an object of this invention to provide an artificial turf surface possessing sufficient integrity to survive the abuse and punishment to which a golf tee surface is exposed by the impact of a golf club.

It is another object of this invention to provide an artificial turf surface that has a porosity which permits rain to pass through the turf and which permits the insertion of a wooden tee to support a golf ball in preparation to hitting the ball.

Another object of this invention is to construct an artificial turf pile surface of sufficient depth to form a cushion to absorb the shock of a golf club striking the surface and which permits a free continuing flow of a golf club head through the surface, thereby providing a complete flow through the swing.

Still another object of this invention is to provide an artificial turf surface which can be made level with the surrounding natural grass turf by implantation and which also provides a solid hitting area which will not move.

A further object of this invention is to provide a method for making an artificial turf product which fulfills the above objectives in an economical and time-saving manner.

BRIEF DESCRIPTION OF THE DRAWINGS

The invention is illustrated in the accompanying drawings wherein:

FIG. 1 shows the stringing of an artificial turf unit of the present invention onto tie rods to form the turf-like product of the present invention. One tie rod has been omitted for illustrative purposes.

FIG. 2 shows a portion of a woven polymeric tape which can be used to form the artificial turf units of the present invention.

FIG. 3 shows the preparation of the skein from a woven tape on a skein winder.

FIG. 4 shows the skein removed from the skein winder.

FIG. 5 shows the top view of a skein being compressed in a vise, fusing of an elongate edge of the skein, and formation of a plurality of holes in the skein by a plurality of heated rods.

FIG. 6 shows unraveling of a portion of the thread from a skein after it is removed from the vise to form an artificial turf unit having a grass-like pile surface.

DETAILED DESCRIPTION OF THE PREFERRED EMBODIMENTS

The artificial turf surface of the present invention comprises a number of artificial turf units 1 which are strung by means of holes 2 onto a plurality of rods 3 as shown in FIG. 1. The tie rods 3 are preferably either threaded rods or rods which are threaded only at their ends. However, unthreaded rods may also be used. Nuts 4 or other appropriate fastening means are secured to the ends of the rods for preventing the turf units from slipping off of the tie rods and for maintaining the turf units tightly compressed together.

Each turf unit 1 comprises a determined number of layers of specially prepared tape. The preferred tape of the present invention is shown in FIG. 2. It may be obtained by slitting a woven or knit polymeric fabric into strips. The width of the strip (or tape) determines the pile height of the artificial turf product. The width of the strips is typically between about ¾" and about 2". The preferred width is about 1½". The strip which is cut from the woven fabric comprises individual grasslike portions 5 which are parallel to each other. The portions 5 are woven together with thread 6 which runs traverse to the length of the grass-like portions 5.

Optionally and preferably, the tape is processed in a warp-running direction through a heating mechanism which fuses the several layers of tape on one edge 7 forming a homogenous tape bundle. A plurality of holes are programmed in determined frequency by a heated plunger which passes successively through the layers of tape. The holes 2 are preferably made in an off-center position favoring the bottom edge 7 of the tape. The fusion of the layers of tape to one another around the peripheral area surrounding each hole develops integrity in the artificial turf unit. Likewise, fusion of the tape layers along their bottom edge 7 provides additional integrity to the artificial turf unit.

The woven or knit polymeric fabric used to prepared the tapes of the present invention may be a polypropylene fabric which is used for primary backing for tufting. When this fabric is cut into strips, the thread 6 extends across the entire width of the strip (or tape). For creation of the grass-like pile surface, the thread 6 is unraveled or otherwise removed (as by means of a wire brush) along the length of the tape from the top edge 8 of the tape down to the holes 6 thus creating a grass-like pile surface. While unraveling of the thread to the holes is preferred, unraveling to points intermediate of the upper edge 8 and the holes are also contemplated. Additionally, the unraveling of the thread 6 may be performed either before or after formation of the holes 2. However, the latter procedure is preferred.

Most preferably, the polymeric fabric from which the tape is cut is woven or knit so as to include alternate elongated areas which are woven or knit with the thread 6 and open elongated areas which do not include the thread 6. This fabric is cut into strips (or tape) so as to include one elongated threaded area and one elongated unthreaded area. With this type of fabric, the tape of FIG. 2 is obtained without the need for unraveling or otherwise removing thread from the top edge 8 downwardly as with the tape cut from the above-described primary backing.

While woven tapes are preferred for their greater porosity and flexibility, non-woven tapes can be used to form the artificial turf units of the present invention. Suitable non-woven tapes are disclosed in U.S. Pat. No. 3,673,056 to Nadler, (herein incorporated by reference) at col. 3 lines 3–47 and are shown in FIGS. 3 and 4 of the patent.

The preferred polymeric material for the tapes (either woven or non-woven) used in the present invention is polypropylene. However, other polymeric materials, particularly thermoplastic ones, and additives such as those disclosed in U.S. Pat. No. 3,673,056 at col. 2 lines 60–69 are suitable.

The length of an artificial turf unit of the present invention typically ranges from six inches to multiples of many feet, depending on the product use or the area to be covered. The thickness of the artificial turf unit is determined by the number of layers of tape and is typically on the order of about ⅛" to about 1.0". The layers of tape forming an artificial turf unit can be a continuous piece of tape which is coiled to form superimposed layers. The layers can also be individual layers which are optionally and preferably fused to each other at their ends 9 and 10.

According to the process of the present invention, as shown in FIG. 3, a single roll of tape 11 is placed on a let-off stand 12 and fed through rollers 13 and 14 onto a modified skein winder 15 until the skein accumulation reaches a thickness of approximately one inch. The length of the skein 16 can range from six inches to multiples of many feet, depending on the product use or the desired size. The skein 16 is then removed from the skein winder 15 as shown in FIG. 4. The removed skein has a bottom elongated end 17 and a top elongated end 18. Both the top and bottom ends are formed by the edges where the fabric was cut to form the tape. As shown in FIG. 5, the skein 16 is then placed in a vise 19 on end, cut end 17 down and cut end 18 facing up. The vise is then closed and the skein is compressed. While in this compressed and fixed position in the vise, a hot roll 20 is passed over the tips of the tape on top end 18 fusing top end 18 of the skein into a solid surface.

While the skein 16 is still in the compressed position, a series of heating element rods 21 are inserted into holes 22 which are programmed in the vise 19 holding the skein 16. By so doing, the heated rods melt their way through the skein 16 creating holes in the skein 16. The skein 16 is additionally reinforced by the fusing that occurs in the inner surface area 23 of the circular hole 2 as shown in FIG. 6. Where the tape was cut from fabric used as primary backing, a portion of the thread 6, must be removed. After the skein 16 is released from the vise, the fused end 18 is placed down as shown in FIG. 6. The woven thread 6 of the skein 16 is then unraveled from the other end 17 down to the fused holes 2 in the skein 16, thereby leaving the filler yarn standing up and thus creating a grass-like pile surface.

After accumulating a sufficient number of these prepared skeins 16, they are then strung onto threaded rods 3 to form a surface area of a desired dimension as shown in FIG. 1. The accumulated skeins are then drawn together by placing nuts 4 on the threaded rods 4 thereby locking the surface securely.

After the skein is removed from the vise, it can be cut to a desired length, the ends fused, and then strung on the tie rods. By using both skeins and tie rods of various lengths or cutting the skeins to various lengths, as indicated, a pile surface of non-rectangular configuration can be achieved. Final skeins of varying length can be obtained by cutting the skein to the desired length after it is removed from the vise and fusing both ends of the cut skein from the bottom to the height of the woven portion of the skein.

I claim:

1. An artificial turf unit comprising superimposed, elongate layers of polymeric tape provided with a plurality of slits extending at least partially across the width of the tape said layers having a plurality of series of holes substantially registered in each series for receiving tie rods for joining several such units, and said layers being coalesced to each other at peripheral, marginal areas around said holes.

2. The artificial turf unit of claim 1 wherein the bottom edges of the tape are fused together.

3. The artificial turf unit of claim 1 wherein said slits extend the full width of the tape, and the bottom portion of the tape is woven together to a height at least equal to the position of said holes.

4. The artificial turf unit cf claim 1 wherein said superimposed elongate layers of tape are a continuous piece of tape which is coiled to form the superimposed layers.

5. The artificial turf unit of claim 1 wherein the side edges of said layers of tape are fused together.

6. A method for making an artificial turf surface comprising winding a polymeric tape having slits which extend at least partially across the width of the tape onto a skein winder to form a skein of superimposed elongated layers of tape, removing said skein from the skein winder and compressing it in a vise, passing a series of heating rods through the vise and the skein to create a series of holes along the length of the skein, the layers of tape being fused to each other around the peripheral marginal areas of each hole and removing the skein from the vise.

7. The method of claim 6 wherein a hot roller is passed along the length of the skein while it is compressed in the vise to fuse one end of the skein into an integral surface.

8. The method of claim 7 wherein the creation of said holes and said integral surface are performed simultaneously.

9. The method of claim 6 wherein said tape is a woven thermoplastic fabric, and after removal of the skein from the vise, the thread of the fabric is unraveled lengthwise of the skein from its top to leave a woven portion extending from the bottom of the skein to a height at least equal to the position of said holes.

10. The method of claim 6 wherein a plurality of skeins are strung on a plurality of tie rods which pass through said holes, and the ends of said rods are secured with fastening means.

* * * * *